US006386821B1

(12) United States Patent
Schneider

(10) Patent No.: US 6,386,821 B1
(45) Date of Patent: May 14, 2002

(54) MOUNTING SYSTEM FOR MID-MOUNT FRONT END LOADERS

(75) Inventor: David Schneider, Great Bend, KS (US)

(73) Assignee: Bush Hog, L.L.C., Selma, AL (US)

( * ) Notice: Subject to any disclaimer, the term of this patent is extended or adjusted under 35 U.S.C. 154(b) by 0 days.

(21) Appl. No.: 09/465,074

(22) Filed: Dec. 16, 1999

(51) Int. Cl.[7] ..... B66C 23/00
(52) U.S. Cl. ..... 414/686; 172/274
(58) Field of Search ..... 414/686, 680, 414/685; 172/272–275

(56) References Cited

U.S. PATENT DOCUMENTS

| | | | | | |
|---|---|---|---|---|---|
| 4,033,469 | A | * | 7/1977 | Frank | 414/686 |
| 4,304,305 | A | * | 12/1981 | Bartel | 414/686 X |
| 4,347,031 | A | | 8/1982 | Friesen et al. | |
| 4,548,543 | A | * | 10/1985 | Lenertz et al. | 414/686 |
| 4,798,511 | A | | 1/1989 | Kaczmarczyk et al. | |
| 4,810,162 | A | | 3/1989 | Foster | |
| 4,906,160 | A | | 3/1990 | Kaufman et al. | |
| 4,936,737 | A | | 6/1990 | Rae et al. | |
| 4,984,958 | A | | 1/1991 | Kaczmarczyk et al. | |
| 4,986,722 | A | | 1/1991 | Kaczmarczyk et al. | |
| 5,135,347 | A | | 8/1992 | Kaczmarczyk et al. | |
| 5,141,385 | A | | 8/1992 | Tibbatts et al. | |
| 5,224,816 | A | | 7/1993 | Kaczmarczyk et al. | |
| 5,387,075 | A | | 2/1995 | Aoki | |
| 5,540,289 | A | * | 7/1996 | Hirooka et al. | 414/686 X |
| 5,620,297 | A | | 4/1997 | Mahaney | |
| 5,727,637 | A | | 3/1998 | Kono et al. | |
| 5,895,199 | A | | 4/1999 | Baumert, III et al. | |

* cited by examiner

*Primary Examiner*—Donald W. Underwood
(74) *Attorney, Agent, or Firm*—Cook, Alex, McFarron, Cummings & Mehler, Ltd.

(57) ABSTRACT

A mounting system is provided by which front end loaders of the mid-mount type are rapidly attached and detached from a tractor or other piece of motive equipment. A procedure for latching and unlatching is also provided, as well as mid-mount front end loaders having a quick attach and quick detach mounting system. A universal mounting bracket assembly is included which can be used on either the right side or the left side and can be used with a variety of front end loader models. A clamp secures together a support, a pedestal pin of the support, and the universal mounting bracket assembly in order to achieve the quick connect of the mid-mount loader onto the tractor.

17 Claims, 10 Drawing Sheets

44
42
43

26
24
25
29
31
42
41
32

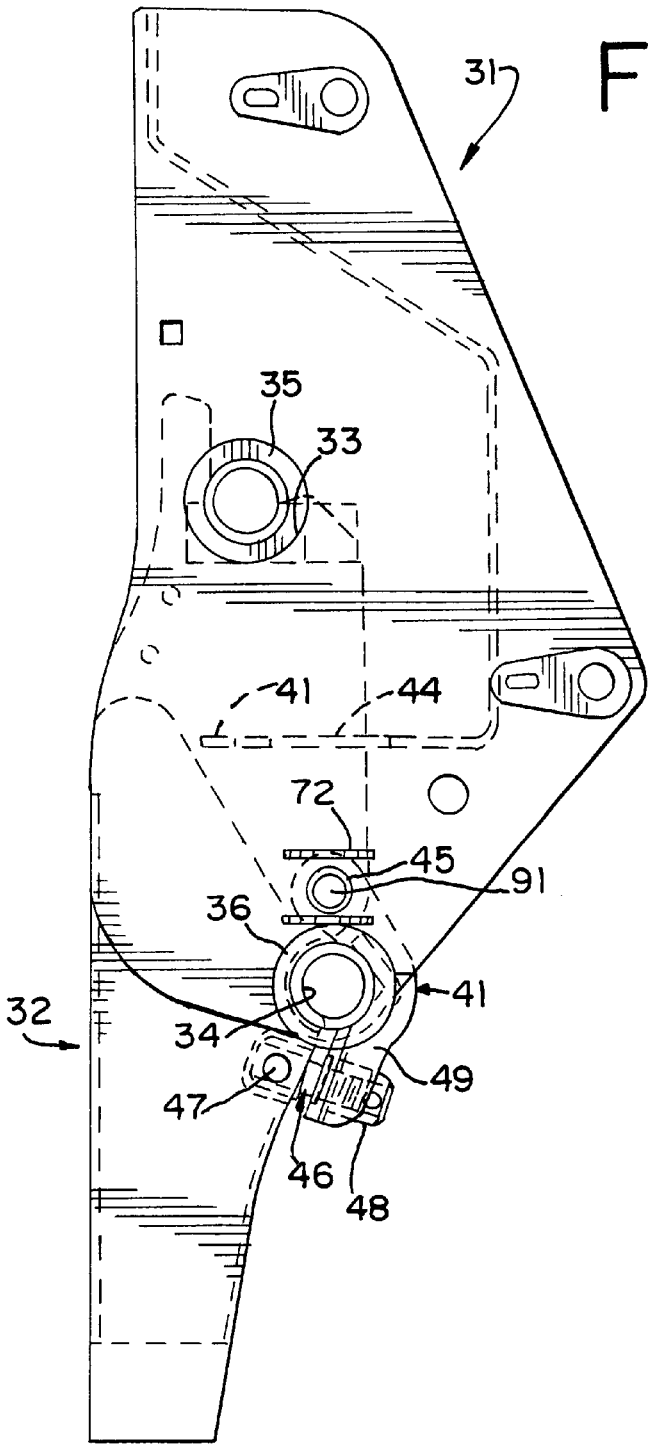
FIG. 5
FIG. 6
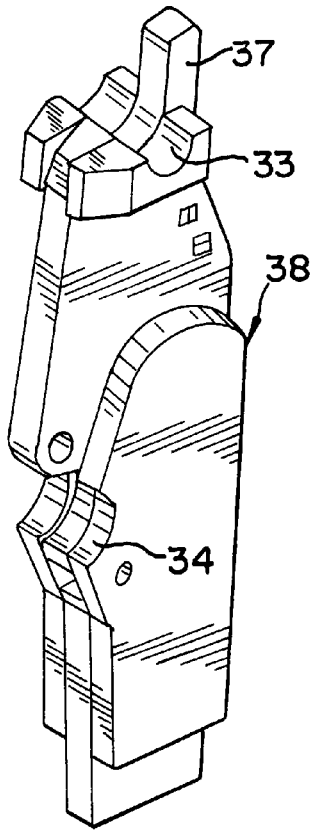

MOUNTING SYSTEM FOR MID-MOUNT FRONT END LOADERS

BACKGROUND OF THE INVENTION

This invention generally relates to front end loaders and especially to mounting systems by which front end loaders are secured to tractors or other suitable equipment. More particularly, the invention relates to front end loaders of the type which are designed to be mounted well into the length the tractor or other motive equipment. These are so-called mid-mount front end loaders, which typically mount at a location to the rear of the front wheels of the equipment. The front end loader has a latch assembly which mates with a mounting bracket assembly secured to the tractor, motive equipment or the like. Securement components are provided which attach the latch assembly and thus the front end loader to the mounting bracket assembly and thus the tractor and the like. Certain of the securement components are assigned respective storage positions when the front end loader is not in use and not secured to the tractor or the like. These attachment components quickly and easily are reoriented and used to securely attach the front end loader to the tractor or the like. This can be accomplished without requiring separate tools to work the transformation between the storage position and the working position of the loader.

Agricultural tractors and other motive type equipment are at times used to perform so-called front end loading tasks which typically involve moving or lifting bulk, heavy and/or oddly shaped items, as well as tasks such as clearing access areas, roads and the like of debris, snow or other obstacles. Typically, it is preferred to avoid having to dedicate a tractor and the like to only front end loader uses. When used herein, the terms tractor or tractor and the like are used to denote equipment which will accept and provide mobility and operability to a front end loader.

It is accordingly important that loader attachments be rapidly and readily connected and disconnected to the tractor which is to provide the operational power and transport capabilities to the front end loader. In this way, the tractor can be used for functions other than front end loading during a portion of the day (or other time period) and for front end loading tasks at other times. It is therefore beneficial for a front end loader to be easily attached and detached from the tractor, vehicle or other suitable equipment.

Loaders with quick or rapid coupling features are generally known. These devices are not always capable of withstanding heavy use and rough handling. Another disadvantage which is encountered for some of these units is the need to use separate tools during the assembly and disassembly operations, which tools are not a part of the loader system. For some prior loader systems, all components are not readily stored on the units themselves when not attached to the tractor and the like.

Front end loaders come in various different sizes and styles, often necessitating quick attachment assemblies which are especially designed in order to accommodate a particular loader make and model. This requires the manufacturing of a variety of assemblies intended for the same purpose but having different size or shape requirements. Such necessitates the manufacture of different assemblies for performing the same function but for different loader makes and models, creating inefficiencies in the use of manufacturing facilities, time, labor and materials.

Accordingly, there is a need for a front end loader mounting system which allows for a mid-mount front end loader to be attached and detached in a matter of minutes.

Such an assembly should also be self-contained, very durable, and not require specific tools to effect the attachment and detachment of the loader. It also would be advantageous to have this type of loader attachment system require a minimum of parts which are specifically designed and made for a particular loader type, size or model.

SUMMARY OF THE INVENTION

In accordance with the present invention, a mounting system is provided for a mid-mount front end loader. The system includes a universal mounting bracket assembly for securing to a mid-mount location of a tractor or other piece of motive equipment, which universal mounting bracket assembly accepts a latch assembly of any number of a variety of front end loader models and sizes. When attached, pedestal pins from the latch assembly rest within respective pedestals of the mounting bracket assembly, and a clamp component secures the latch assembly and thus the front end loader to the universal mounting bracket assembly and thus the motive equipment. Securement components lock the clamp in place in order to maintain its clamping function so that the latch assembly and mounting bracket assembly remain firmly secured together, even during rugged operation of the front end loader.

It is accordingly a general object of the present invention to provide an improved mounting system for front end loaders, front end loaders employing such a system, and a procedure for rapidly and easily engaging and disengaging the front end loader from a motive piece of equipment such as a tractor.

Another object of this invention is to provide an improved mounting system for mid-mount front end loaders, as well as procedures for attaching and detaching the front end loaders from motive equipment, which system and procedures incorporate a universal mounting bracket assembly to thereby reduce the number of components which must be manufactured, assembled and warehoused.

Another object of the present invention is to provide an improved front end loader mounting system and procedure which allow for mounting and dismounting easily within reasonable manufacturing tolerances without sacrificing versatility and durability.

Another object of this invention is to provide improved mid-mount front end loader mounting system apparatus and procedure wherein a plurality of securement components are safely and securely stored on the front end loader when unattached to a tractor and are easily and conveniently transformed into working positions at which attachment is accomplished, this being achieved without requiring any devices or tools separate from the apparatus itself.

These and other objects, features and advantages of the present invention will be apparent from and clearly understood through a consideration of the following detailed description.

BRIEF DESCRIPTION OF THE DRAWINGS

In the course of this description, reference will be made to the attached drawings, wherein:

FIG. 5 is an enlarged, detail view of the assembled attachment components as generally shown in FIG. 4;

FIG. 6 is a perspective view of a preferred embodiment of the universal mounting bracket assembly according to the invention;

DESCRIPTION OF THE PREFERRED EMBODIMENTS

Figure 1:
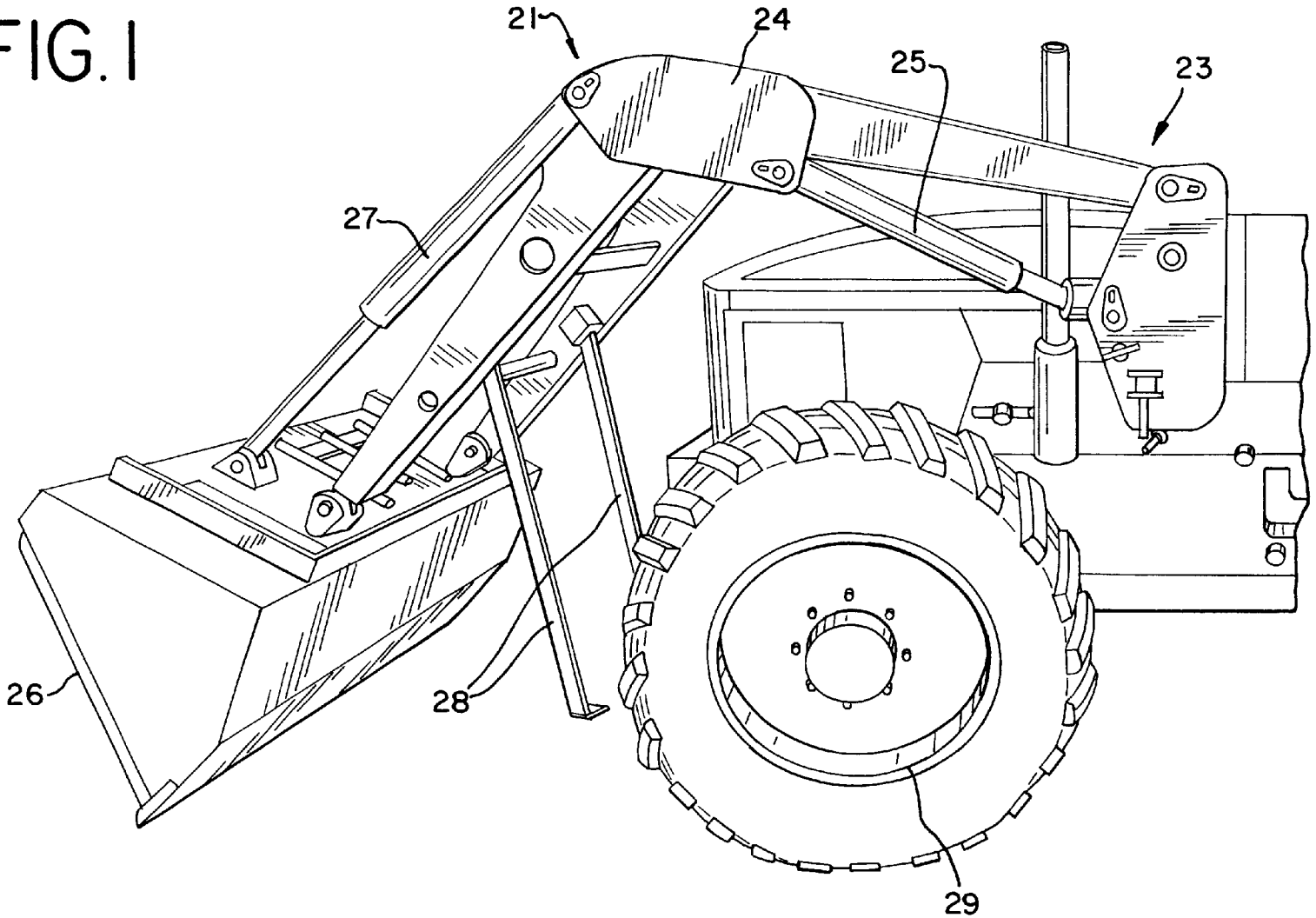
FIG. 1 is a perspective view showing a mid-mount loader secured to a tractor.

The present invention is generally illustrated in FIG. 1, which shows a front end loader generally designed as 21. Also shown is a front portion of a tractor as an illustration of a suitable piece of motive equipment. A mounting system is generally shown at 23. Loader 21 is a mid-mount front end loader having a frame assembly 24, attachment control cylinders 25, a bucket 26, a bucket control cylinder 27 and parking stands 28. It will be noted that the mounting system 23 is rearward of tractor wheels 29.

Figure 2:
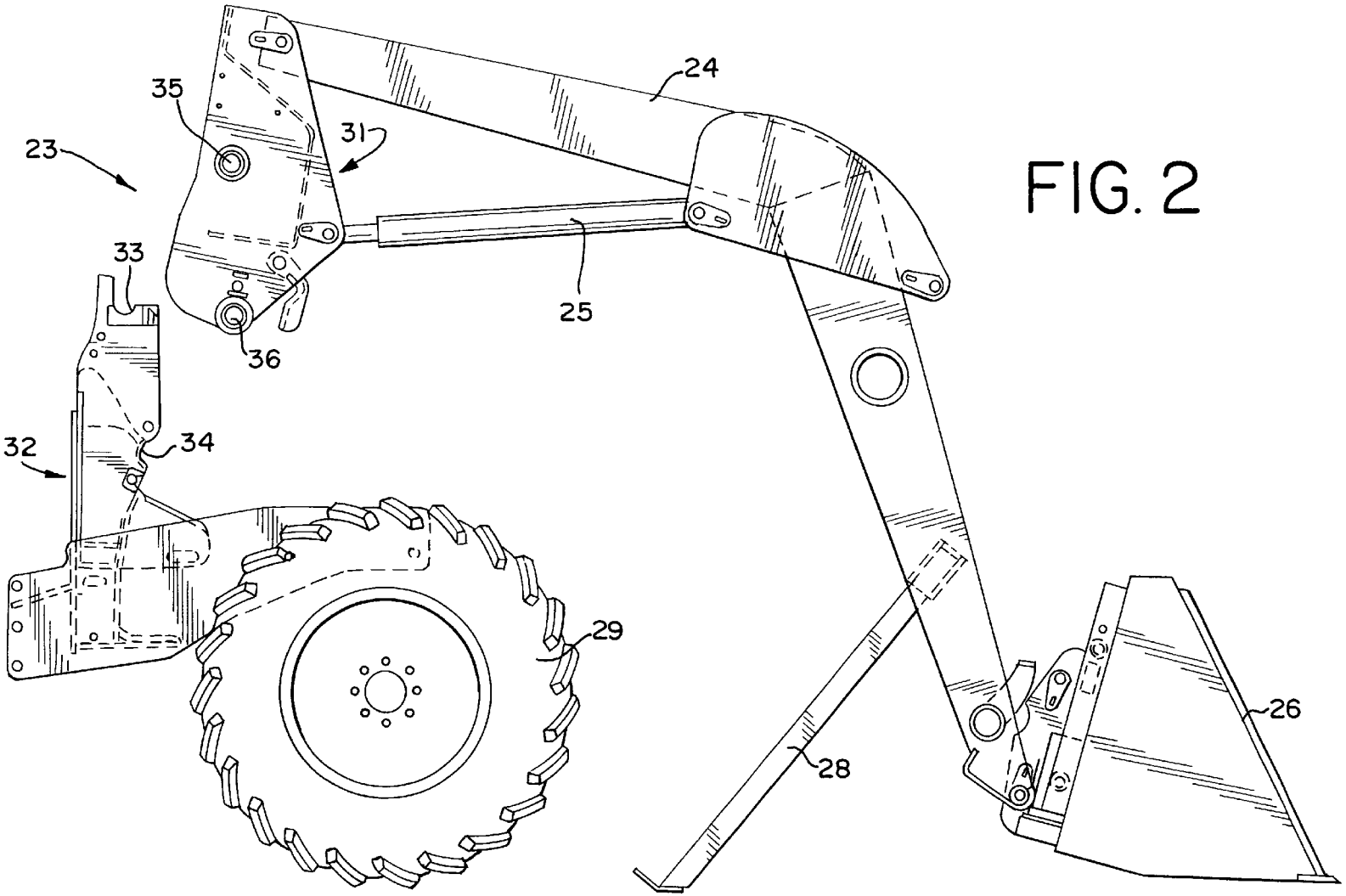
FIG. 2 is a side elevational view of a front end loader and the mounting system in accordance with the invention, shown in a parked orientation, with a tractor being shown schematically moving toward the parked loader.

FIG. 2 shows the front end loader 21 in its parked condition, the parking stands 28 and the bucket 26 resting upon generally level ground. An embodiment of the latch assembly is generally designated at 31. A mounting bracket assembly is generally designated at 32. It will be appreciated that in FIG. 2, the tractor is signified by wheel 29. Included is a pedestal 33. A second pedestal 34 also is shown. Each pedestal is positioned, sized and shaped to receive, in generally nesting fashion, pedestal pins 35 and 36, respectively.

Figure 3:
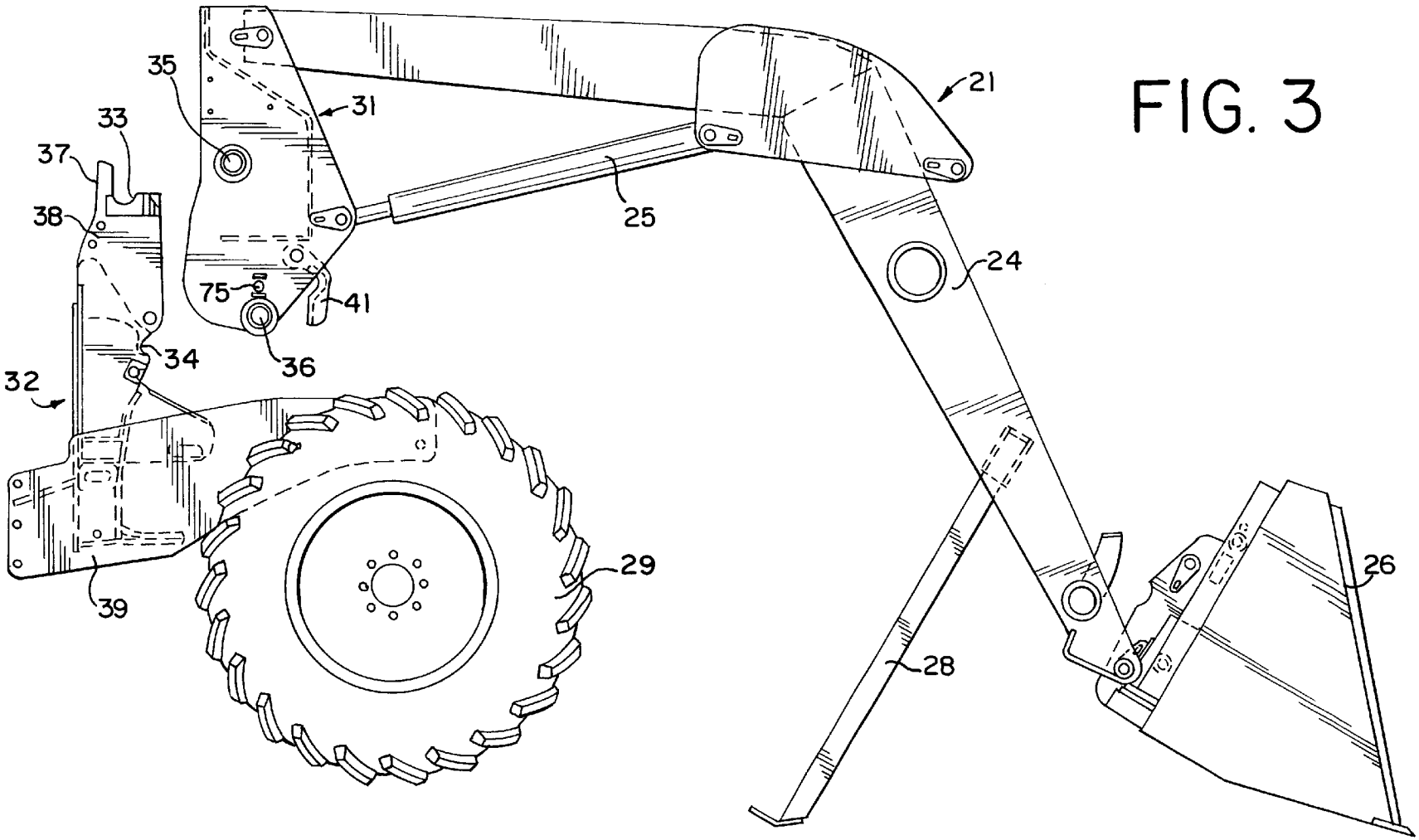
FIG. 3 is a view similar to FIG. 2, with the lift cylinder retracted for alignment of the loader latch assembly with the mounting bracket assembly on the tractor.

In FIG. 3, attachment control cylinder or lift cylinder 25 is shown retracted until the respective pedestal pins 35, 36 are positioned in general horizontal and lateral alignment with and for entry into respective pedestals 33, 34. In this regard, a guide projection 37 is provided to facilitate proper seating of the pedestal pins within the pedestals. More particularly, the operator will move the motive equipment into the parked front end loader 21 generally and raise lower pedestal pin 35 by adjusting the bucket control cylinder FIG. 1) until pedestal pin 35 is engaged by the guide projection 37. At that stage, minor adjustment of the lift cylinder 25 can be carried out, if necessary, in order to complete the nesting function.

Mounting bracket assembly 32 includes a universal mounting bracket assembly 38, together with a tractor mounting bracket 39. Assembly 32 can be considered to be a mounting kit which can be substantially permanently secured to a tractor or other piece of motive equipment. Even if the tractor mounting bracket 39 is specifically designed for a particular tractor, for example, the universal mounting bracket assembly 38 itself need not be modified to accommodate that particular tractor.

Figures 4, 4A:
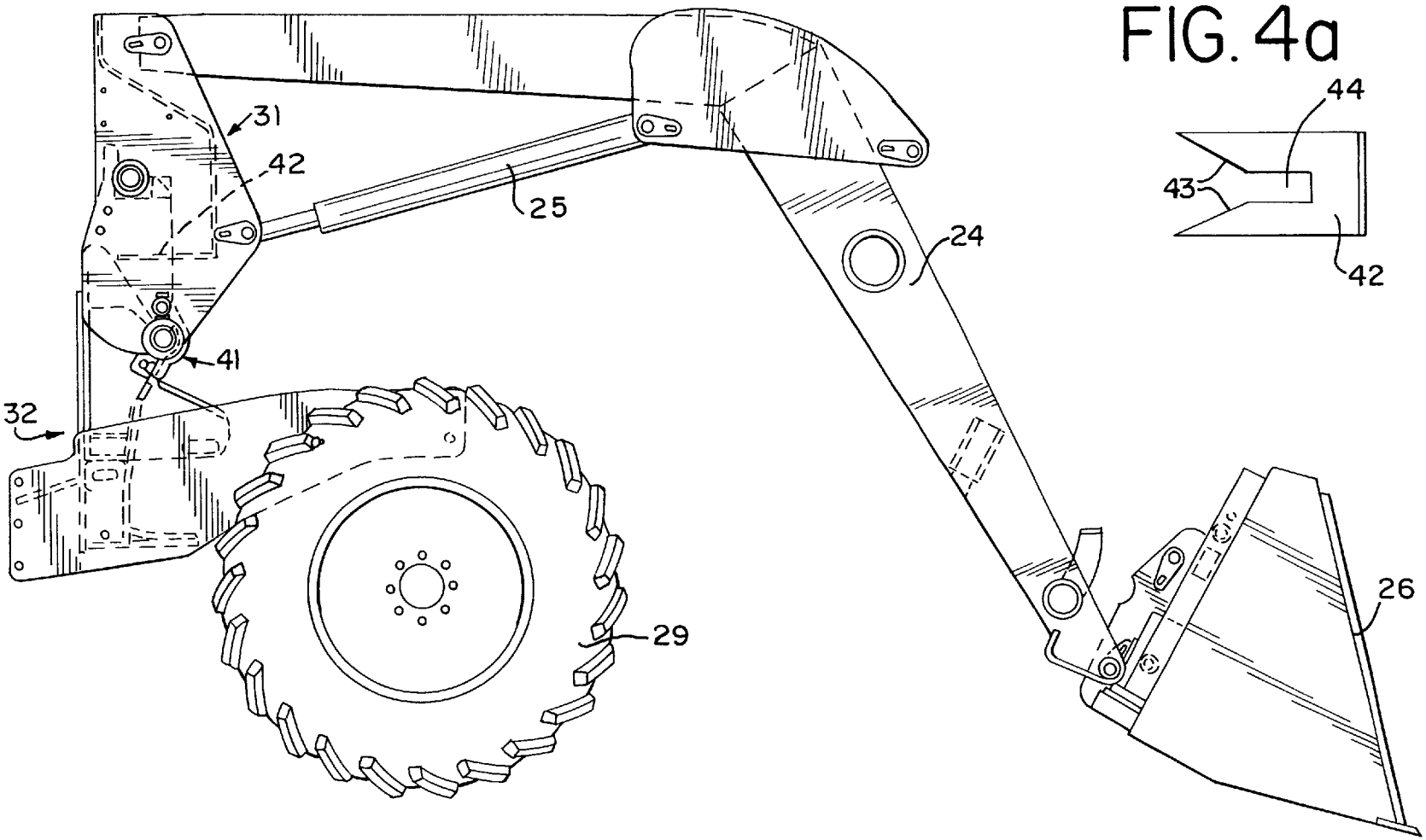
FIG. 4 is a side elevational view along the lines of FIG. 2, showing the loader fully installed and parking stands in their storage position.
FIG. 4A is a plan view of a detail of a preferred component of the latch assembly.
Figure 7:
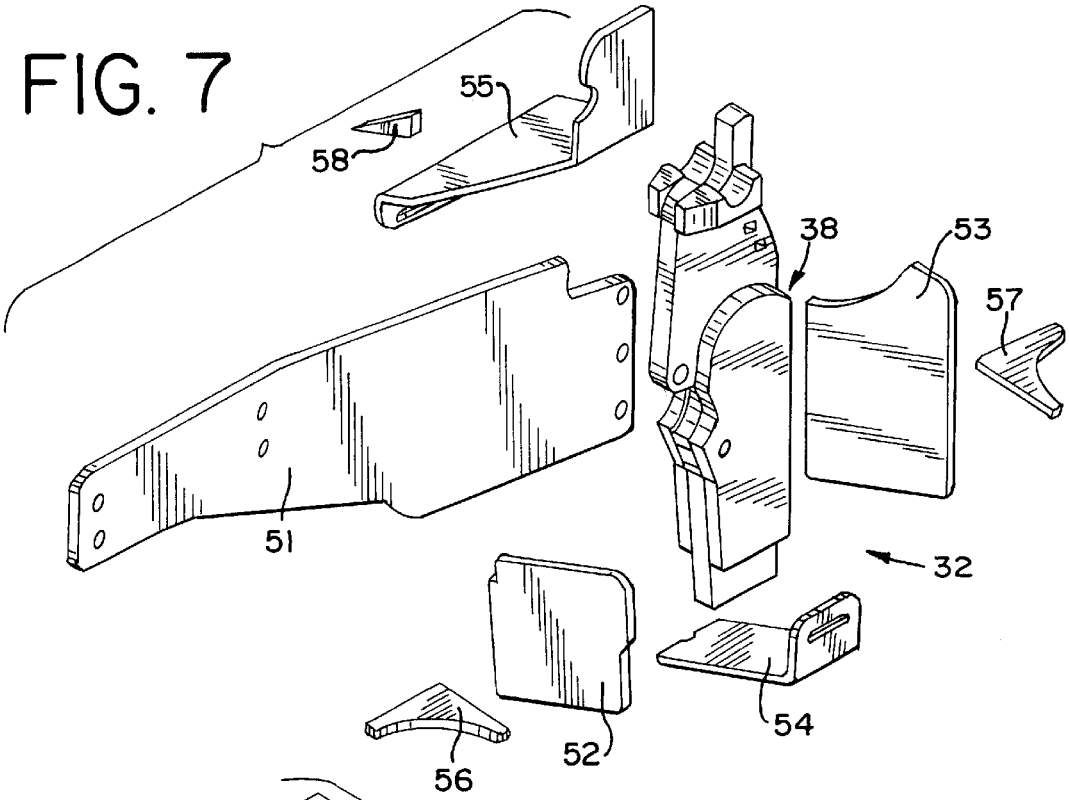
FIG. 7 is an exploded perspective view showing the universal mounting bracket assembly of FIG. 6 in association with mounting kit components by which the universal mounting bracket assembly is secured to a tractor.

After the nesting of the pedestal pins into the pedestals is completed, a clamp assembly 41 is secured as described in greater detail herein. During movement of the mounting bracket assembly 32 into the latch assembly 31, further alignment guidance is preferably provided by an internal guide plate 42 having tapered access ramps 43 opening into a receptor slot 44, as generally shown in FIG. 4A.

Greater detail of the latch assembly 31 and mounting bracket assembly 32, as secured together, are found in FIG. 5. A first securement component 45 and a second securement component 46 are shown in place so as to lock down the latch assembly 31 onto the mounting bracket assembly 32. The primary function of these securement components is to maintain proper placement of the clamp assembly 41 in a manner which will remain secure even during rough use typically associated with equipment and implements of this general type. For ease of operation and convenience, it is preferred that these securement components are easily stored on the front end loader itself when the front end loader is not attached to motive equipment such as a tractor. A particular embodiment is primarily shown herein, but it will understood that other specific structures are possible.

In this illustrated embodiment, the first securement component 45 is in the form of an elongated pin which is generally horizontally extending. Illustrated second securement component 46 is generally T-shaped. A generally transverse portion 47 of securement component 46 is shown to be generally parallel to the pin securement component 45. A longitudinal portion 48 of the securement component 46 connects the transverse portion 47 to clamp member 49 when the loader is attached to the tractor.

Figure 8:
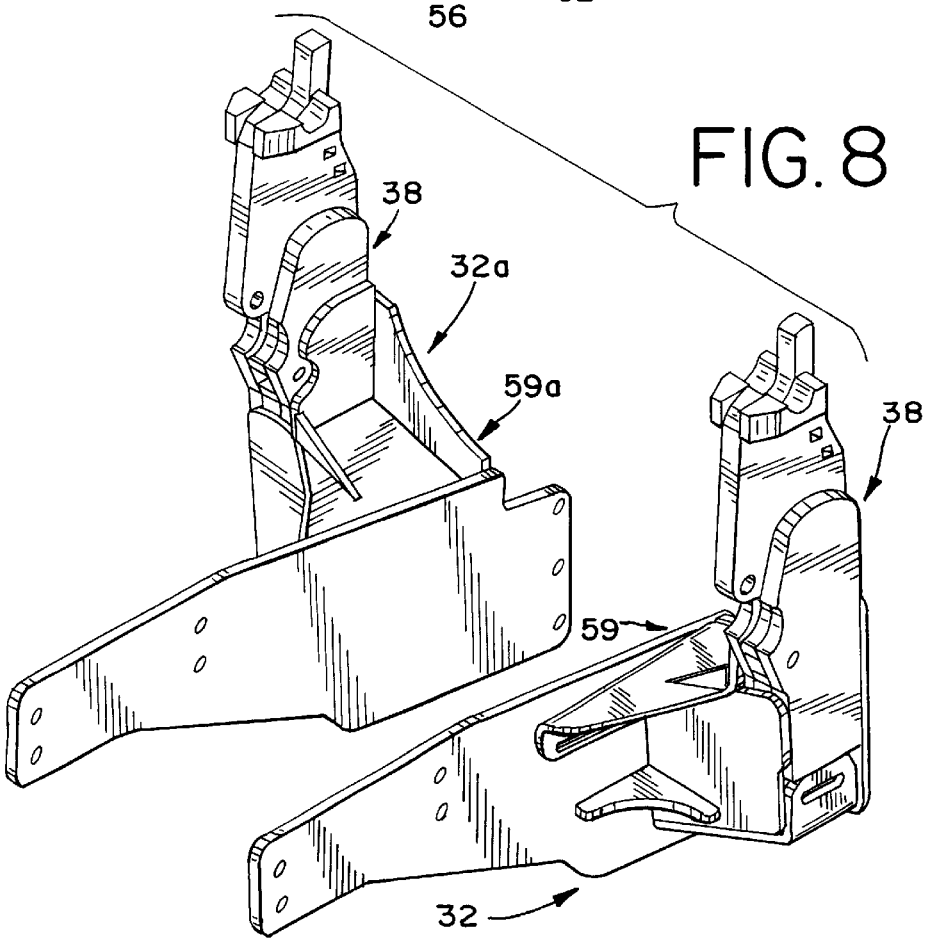
FIG. 8 is a perspective view illustrating a typical relationship of two as-mounted universal mounting bracket assembles in association with tractor securement brackets.
Figure 9B:
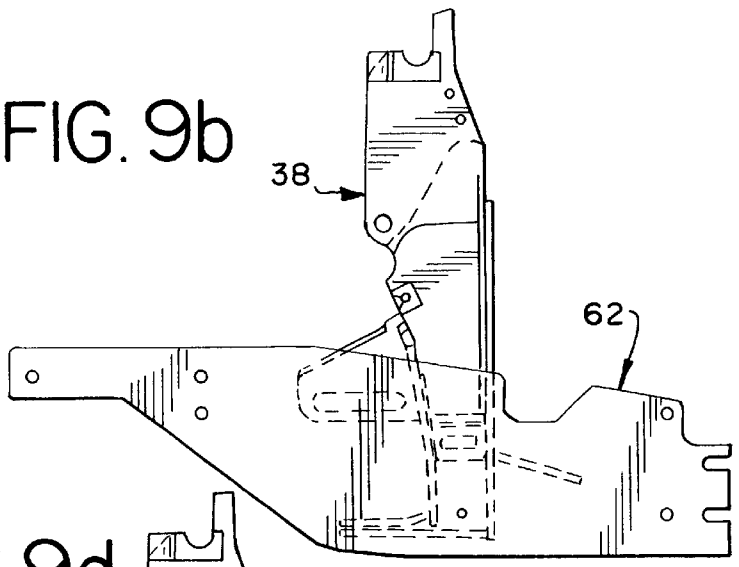
FIGS. 9*a*, 9*b*, 9*c* and 9*d* are side elevational views providing examples of tractor mounting kits for different types of tractors.
Figure 9D:
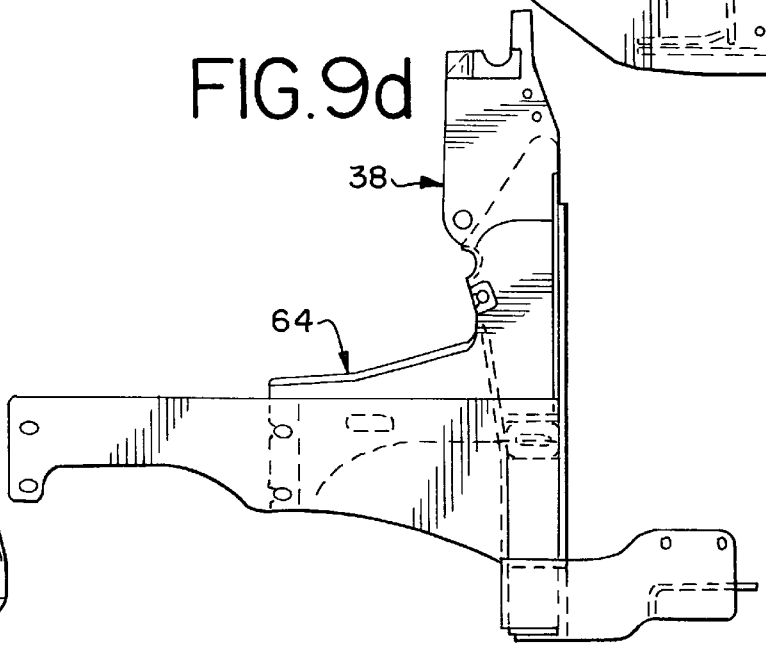
Figure 9A:
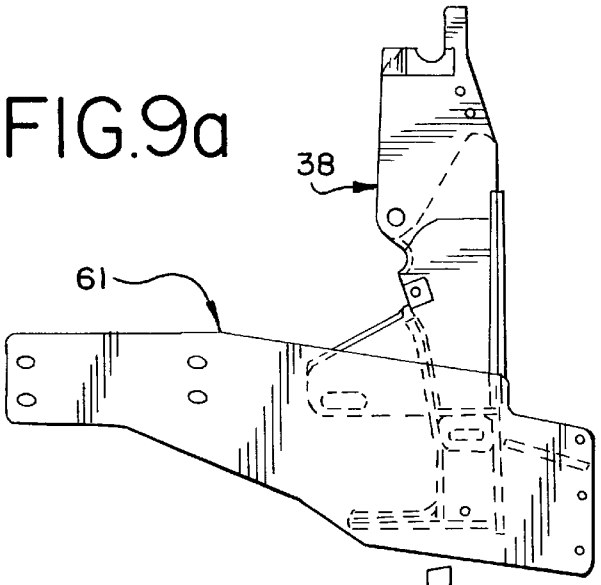
Figure 9C:
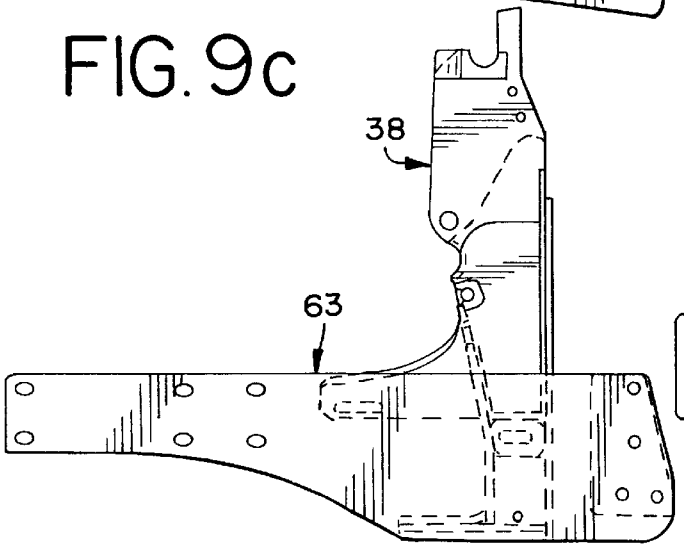

Further details of the mounting bracket assembly 32 are provided in FIGS. 6, 7, 8, 9*a*, 9*b*, 9*c* and 9*d*. For example, in FIG. 7, assembly components of a typical tractor mounting bracket assembly are shown. The illustrated assembly includes a mounting rail 51, as well as a front member 52, a rear member 53, a bottom member 54 and a top cap 55. These members provide rigid, stable and secure upwardly extending mounting of the universal bracket assembly 38, which structure is enhanced by the plurality of gussets such as those shown at 56, 57 and 58. FIG. 8 shows completed construction of a pair of mounting bracket assemblies 32, 32*a*. It will be appreciated that, in each of the mounting bracket assemblies 32 and 32*a*, the universal mounting bracket assembly 38 is identical, irrespective of whether same is positioned on the left or the right. Accordingly, during manufacture of the mounting bracket assembly, identical universal mounting bracket assemblies 38 are manufactured and assembled into any one of a number of attachment assemblies 59, 59*a* (FIG. 8), 61 (FIG. 9*a*), 62 (FIG. 9*b*), 63 (FIG. 9*c*) or 64 (FIG. 9*d*).

Figure 10:
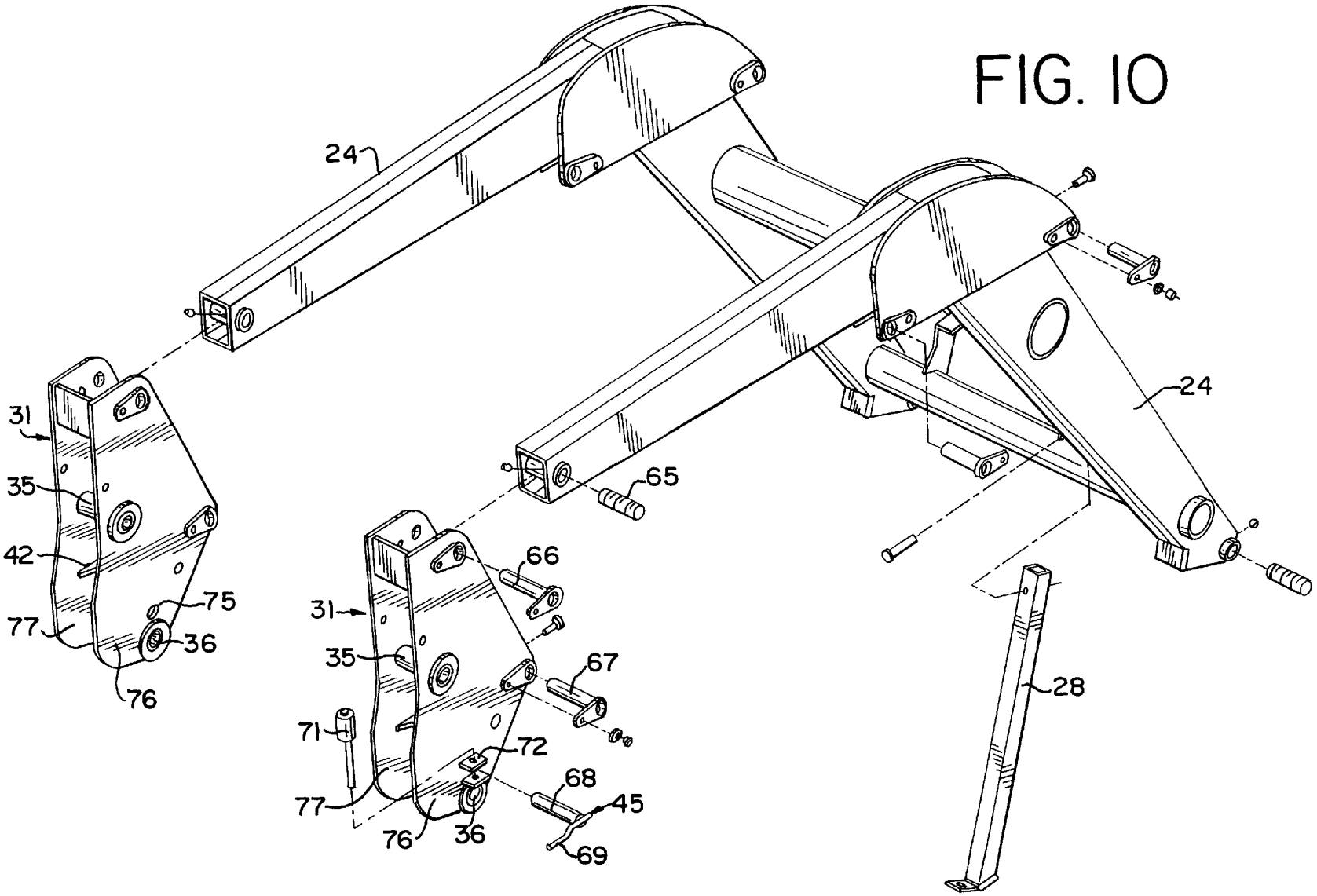
FIG. 10 is a perspective view, somewhat exploded, of a mid-mount loader frame having latch assemblies according to the invention.

Additional details of the latch assemblies 31 and of the loader frame 24 are shown in FIG. 10. Each latch assembly 31 is rotatably mounted to frame assembly 24 by any suitable structure, included the illustrated rod 65 received within sleeve 66. A similar pivotal mount can be provided for the lift cylinder 25, this mounting being generally represented in FIG. 10 by the sleeve 67. Certain aspects of a preferred embodiment of the first securement component 45 also are shown in FIG. 10. Included is a so-called quick pin having a shaft 68 and a handle 69. Also shown in this view as a component of the mounting bracket assembly is a handle wrench 71, fashioned for reception within projecting shelf member 72 of the latch assembly. Shelf member can take the form of generally parallel projections as shown in FIG. 10 or as a single projection, such as one which is generally C-shaped.

Figure 11:
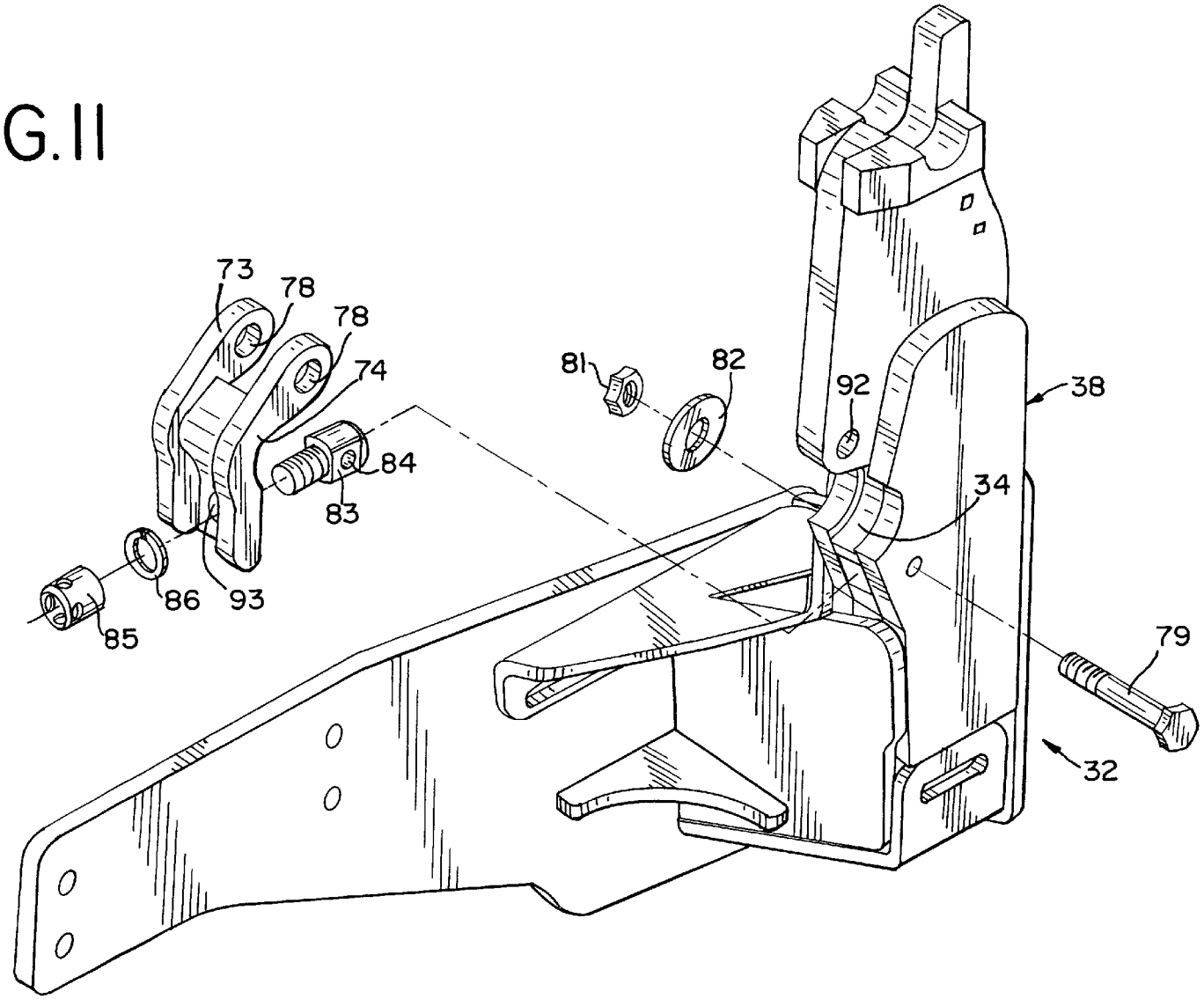
FIG. 11 is a perspective view, partially exploded, particularly illustrating a preferred clamp assembly.

FIG. 11 provides specific details of a preferred embodiment of the second securement component, this being particularly efficient and cost effective to manufacture. In this illustrated embodiment, a clamp member or assembly 73 is provided with an internal or engaging surface 74 which is configured and sized so as to engage one of the pedestal pins, with the objective of clamping same between the latch assembly 31 and the mounting bracket assembly 32. In this illustrated embodiment, clamp 73 clamps lower pedestal pin 36 up against lower pedestal 34. By virtue of its being securely attached to both the latch assembly 31 and to the mounting bracket assembly 32, clamp 73 secures together each of latch assembly 31, mounting bracket assembly 32 and pedestal pin 36.

Turning now to the specific clamp securing arrangements which are shown in this embodiment, the first securement component 45 takes the form of a so-called quick pin, composed of shaft 68 and handle 69 (FIG. 10). When the system is in its attached or working position, shaft 68 rests within openings 75 through each support plate 76 and 77. Shaft 68 also passes through hole 78 of the clamp 73, two such holes being shown in FIG. 11. As is perhaps best seen in FIG. 14, the handle 69 of this illustrated quick pin is positioned for engagement with one of the support plates 76, thereby preventing passage of the shaft 68 through opening 75. Prevention of any substantial movement of the shaft 68 out of opening 75 is preferably prevented by another component of the assembly, as discussed elsewhere herein.

Securement of the clamp 73 to the mounting bracket assembly 32 takes the form, in the embodiment illustrated in FIG. 11, of a generally T-shaped securement component. This overall configuration allows for the longitudinal portion 48 of this securement component to remain permanently attached to the mounting bracket assembly 32. In FIG. 11, this takes the form of a simple hex bolt 79, which is secured in place in any customary or suitable manner, such as by the illustrated hex nut 81 and washer 82.

The longitudinal portion is permanently secured to the transverse portion in any suitable or customary manner. In the embodiment which is illustrated in FIG. 11, the manner by which the longitudinal portion is secured to the transverse portion is an arrangement which can provide for some limited rotation of the longitudinal portion with respect to the transverse portion, to the extent such might be necessary to facilitate attachment and disattachment action. In FIG. 11, an eye bolt 83 is a primary component of the longitudinal portion of the second securement component 46. Bolt 79 passes through its eye 84, which effectively secures this longitudinal portion of the T-shaped assembly to its transverse portion. Continuing further with the embodiment illustrated in FIG. 11, an extension nut 85, in combination with lock washer 86, secures the clamp 73 to the mounting bracket assembly 32.

Figure 12:
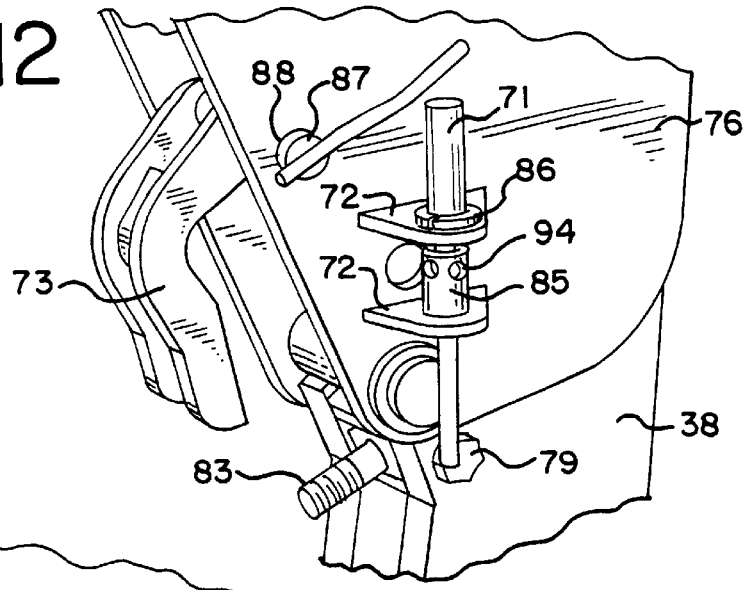
FIG. 12 is an enlarged, detail side elevational view showing a preferred combination of securement components mounted in storage position onto the illustrated latch assembly.
Figure 13:
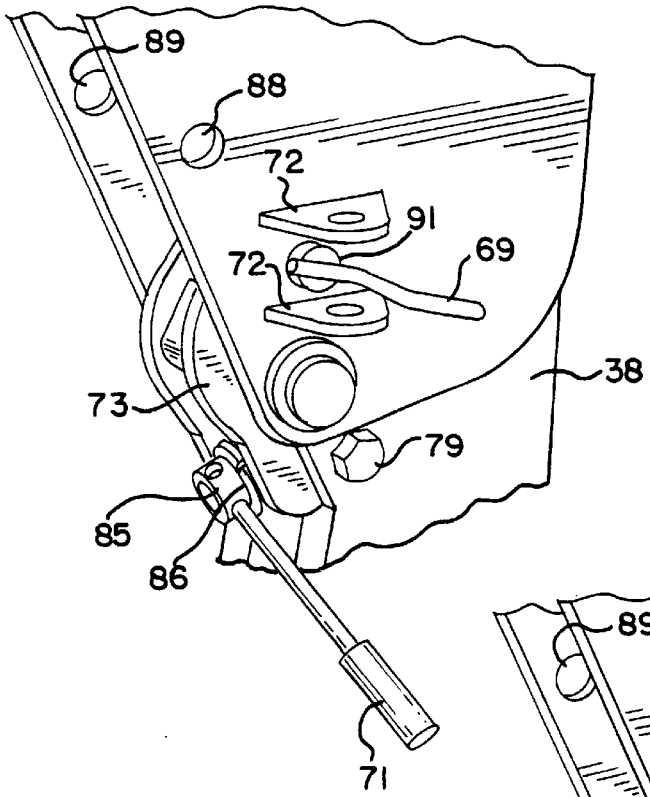
FIG. 13 is a side elevational view similar to FIG. 12 and illustrating positions of various components intermediate of the storage and working positions.
Figure 14:
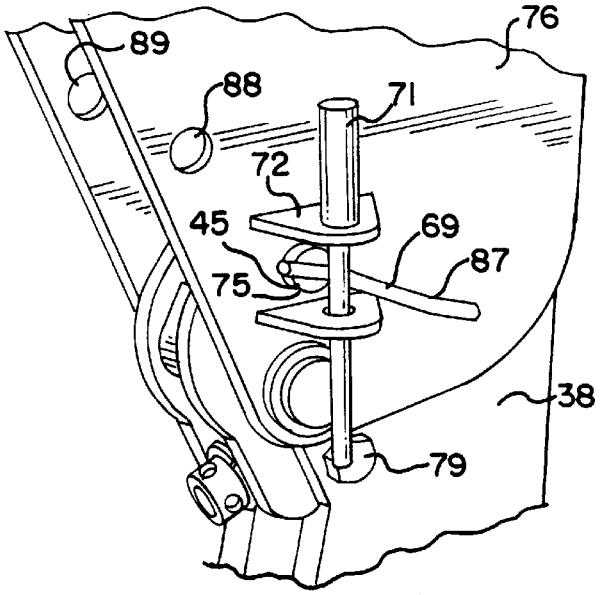
FIG. 14 is a perspective view showing the embodiment of FIGS. 12 and 13, with the various components being in their respective working positions for full attachment of the loader onto the tractor.

Further details regarding the operation of the specific embodiment that is illustrated in FIG. 10 and FIG. 11 are found in FIGS. 12, 13 and 14. These figures illustrate generally the sequence of operations by which the respective locations of various components are transformed or used to move from a storage position as shown in FIG. 12 through a working position as shown in FIG. 14. At the storage positions shown in FIG. 12, the extension nut 85 and the lock washer 86 are positioned along the handle wrench 71 which is stowed on a projecting shelf 72. The storage position of illustrated quick pin 87 is within storage openings 88, 89 (FIG. 14). T-shaped securement component comprising transverse bolt 79 and longitudinal eye bolt 83 are shown at rest on the universal mounting bracket assembly 38, which is not as yet secured to the latch assembly 31. Clamp 73 is shown still in its storage position on the latch assembly 31.

Reorientation of the various members from this storage position to the working position begins with removal steps. Each of the handle wrench 71, the quick attach nut or extension nut 85, and the lock washer 86 are removed from the projecting shelf 72. In addition, the quick pin 87 and the clamp 73 are removed from their storage positions as shown in FIG. 12 to their working positions as shown in FIG. 13. More specifically, quick pin 87 is passed through opening 91 at shelf member 72 and through a clamp mounting hole 92 (FIG. 11) of the universal mounting bracket assembly 38 (after same had been moved into general alignment with opening 91), thereby permitting continued passage of quick pin 87 through and into an opening (not shown) through the other plate of the latch assembly 31, this opening being generally similar to opening 91. This working position of the quick pin 87 is one in which quick pin handle 69 prevents further passage of the quick pin through the opening 91. With this alignment completed, the clamp 73 readily swings over eye bolt 83, which passes through hole 93 of the clamp 73.

Next, as generally visible in FIG. 13, the lock washer 86 and extension nut 85 are installed over the eye bolt 83. This installation is easily facilitated by use of the handle wrench 71 which readily fits through slots 94 of the extension nut, as is generally illustrated in FIG. 13. Spacing of these holes and slots 94 along the periphery of the extension nut 85 allows the handle wrench to be inserted at multiple locations so that the operator's hand can easily clear surrounding components when loosening or tightening the extension nut 85.

Thereafter, as evident in FIG. 14, the handle wrench 71 is returned to its storage position. At this location, the handle wrench 71 prevents any substantial outward movement of the quick pin 87 out of the opening 91. If desired, appropriate measures may be taken to secure handle wrench 71 in its FIG. 14 position, such as by having force fit engagement between the shaft of the handle wrench 71 and the installed quick pin 87. Alternatively or additionally, threading of one or more components can be provided.

It will be appreciated that an important advantage of the present invention is that the front end loader and the latch assembly depending therefrom are not directly attached to the frame of the motive equipment or tractor. Instead, the attachment is to the mounting bracket assembly 32. When the assembly components are clamped together, a clearance hole permits one to get the quick pin in and out. When it is desired to take the quick pin out and remove the lock, this is readily accomplished. The quick pin is, in effect, a secondary latch. One needs to pull the pin out of its working position before it is possible to have the front end loader removed from the tractor or the like.

It will be understand that the embodiments of the present invention which have been described are illustrative of some of the applications of the principles of the present invention. Numerous modifications may be made by those skilled in the art without departing from the true spirit and scope of the invention.

What is claimed is:

1. A mounting system for a mid-mount front end loader, comprising:

a latch assembly adapted to be secured to a frame of a front end loader for mounting the loader in mid-mount fashion to a piece of motive equipment, said latch assembly including a support, a first pedestal pin, a second pedestal pin, and a clamp component;

a mounting bracket assembly adapted to be secured to a mid-mount location of a piece of motive equipment, said mounting bracket assembly including:

a bracket assembly support, a first pedestal supported by said bracket assembly support, said first pedestal being sized and shaped to receive said first pedestal pin, and a second pedestal supported by said bracket assembly support, said second pedestal being sized and shaped to receive said second pedestal pin;

a first securement component which attaches said support of the latch assembly to one portion of said clamp component of the latch assembly;

said first securement component is a pin, said bracket assembly support has a receptor hole, and said pin is within said receptor hole when said latch assembly and said mounting bracket assembly are assembled together;

a second securement component which is secured to said support of the mounting bracket assembly when said latch assembly and said mounting bracket assembly are assembled together, and said second securement component attaches said support of the mounting bracket assembly to another portion of said clamp component of the latch assembly; and said second securement component which is secured to said support of the mounting bracket assembly has a generally longitudinal portion which projects from said support of the mounting bracket assembly and toward which said clamp component swings and to which said clamp component is secured when said latch assembly and said mounting bracket assembly are assembled together.

2. A mounting system for a mid-mount front end loader, comprising:

a latch assembly adapted to be secured to a frame of a front end loader for mounting the loader in mid-mount fashion to a piece of motive equipment, said latch assembly including a support, a first pedestal pin, a second pedestal pin, and a clamp component;

a mounting bracket assembly adapted to be secured to a mid-mount location of a piece of motive equipment, said mounting bracket assembly including:

a bracket assembly support having a receptor hole, a first pedestal supported by said bracket assembly support, said first pedestal being sized and shaped to receive said first pedestal pin, and a second pedestal supported by said bracket assembly support, said second pedestal being sized and shaped to receive said second pedestal pin;

a pin which attaches said support of the latch assembly to one portion of said clamp component of the latch assembly, and said pin is within said receptor hole when said latch assembly and said mounting bracket assembly are assembled together;

said pin is a quick pin having a shaft and a handle, said shaft is within said receptor hole when said latch assembly and said mounting bracket assembly are assembled together, and said handle engages said support of the latch assembly to prevent inward movement of said quick pin; and a securement component which attaches said support of the mounting bracket assembly to another portion of said clamp component of the latch assembly.

3. A mounting system for a mid-mount front end loader, comprising:

a latch assembly adapted to be secured to a frame of a front end loader for mounting the loader in mid-mount fashion to a piece of motive equipment, said latch assembly including a support, a first pedestal pin, a second pedestal pin, and a clamp component;

a mounting bracket assembly adapted to be secured to a mid-mount location of a piece of motive equipment, said mounting bracket assembly including:

a bracket assembly support, a first pedestal supported by said bracket assembly support, said first pedestal being sized and shaped to receive said first pedestal pin, and a second pedestal supported by said bracket assembly support, said second pedestal being sized and shaped to receive said second pedestal pin;

a first securement component which attaches said support of the latch assembly to one portion of said clamp component of the latch assembly;

a second securement component which attaches said support of the mounting bracket assembly to another portion of said clamp component of the latch assembly;

said second securement component is generally T-shaped and has a generally transverse portion which is secured to said support of the mounting bracket assembly, and said generally T-shaped component has a generally longitudinal portion which is secured to said clamp component when said latch assembly and said mounting bracket assembly are assembled together; and said generally longitudinal portion includes an eye bolt having an eye through which the generally transverse portion is positioned.

4. The mounting system according to claim 3, wherein said generally longitudinal portion further includes an extension nut which secures said clamp onto said generally longitudinal portion.

5. The mounting system according to claim 2, further including a handle wrench supported from said support of the latch assembly, and said handle wrench is positioned for engagement of said quick pin to prevent outward movement of said quick pin.

6. The mounting system according to claim 5, wherein said handle wrench is supported from said support of the latch assembly by a projecting shelf member having at least one hole through which said handle wrench passes.

7. The mounting system according to claim 1, wherein said first securement component has a storage position on said support of the mounting bracket assembly when said latch assembly and said mounting bracket assembly are not assembled together.

8. A mounting system for a mid-mount front end loader, comprising:

a latch assembly adapted to be secured to a frame of a front end loader for mounting the loader in mid-mount fashion to a piece of motive equipment, said latch assembly including a support, a first pedestal pin, a second pedestal pin, and a clamp component;

a mounting bracket assembly adapted to be secured to a mid-mount location of a piece of motive equipment, said mounting bracket assembly including:

a bracket assembly support, a first pedestal supported by said bracket assembly support, said first pedestal being sized and shaped to receive said first pedestal pin, and a second pedestal supported by said bracket assembly support, said second pedestal being sized and shaped to receive said second pedestal pin;

a first securement component which attaches said support of the latch assembly to one portion of said clamp component of the latch assembly;

a second securement component which attaches said support of the mounting bracket assembly to another portion of said clamp component of the latch assembly; and said latch assembly includes an internal guide which receives and engages said bracket assembly support when said latch assembly and mounting bracket assembly are assembled together, said internal guide including a receptor slot within which said bracket assembly support is received.

9. The mounting system according to claim 1, wherein said mounting bracket assembly further includes a mounting assembly to be secured to the piece of motive equipment.

10. A front end loader for mounting to a piece of motive equipment, comprising:

a front end loader frame having a working end location and an attachment end location;

a bucket attached to said working end location of the frame;

a latch assembly secured to said attachment end location of the frame for mounting the loader in mid-mount fashion to a piece of motive equipment, said latch assembly including a support, a first pedestal pin, a second pedestal pin, and a clamp component;

a mounting bracket assembly adapted to be secured to a mid-mount location of a piece of motive equipment, said mounting bracket assembly including:

a bracket assembly support, a first pedestal supported by said bracket assembly support, said first pedestal being sized and shaped to receive said first pedestal pin, and a second pedestal supported by said bracket assembly support, said second pedestal being sized and shaped to receive said second pedestal pin;

a first securement component which attaches said support of the latch assembly to one portion of said clamp component of the latch assembly;

said first securement component is a pin, said bracket assembly support has a receptor hole, and said pin is within said receptor hole when said latch assembly and said mounting bracket assembly are assembled together;

a second securement component which is secured to said support of the mounting bracket assembly when said latch assembly and said mounting bracket assembly are assembled together, and said second securement component attaches said support of the mounting bracket assembly to another portion of said clamp component of the latch assembly; and said second securement component which is secured to said support of the mounting bracket assembly has a generally longitudinal portion which projects from said support of the mounting bracket assembly and toward which said clamp component swings and to which said clamp component is secured when said latch assembly and said mounting bracket assembly are assembled together.

11. A front end loader for mounting to a piece of motive equipment, comprising:

a front end loader frame having a working end location and an attachment end location;

a bucket attached to said working end location of the frame;

a latch assembly secured to said attachment end location of the frame for mounting the loader in mid-mount fashion to a piece of motive equipment, said latch assembly including a support, a first pedestal pin, a second pedestal pin, and a clamp component;

a mounting bracket assembly adapted to be secured to a mid-mount location of a piece of motive equipment, said mounting bracket assembly including:

a bracket assembly support having a receptor hole, a first pedestal supported by said bracket assembly support, said first pedestal being sized and shaped to receive said first pedestal pin, and a second pedestal supported by said bracket assembly support, said second pedestal being sized and shaped to receive said second pedestal pin;

a pin which attaches said support of the latch assembly to one portion of said clamp component of the latch assembly and said pin is within said receptor hole when said latch assembly and said mounting bracket assembly are assembled together;

said pin is a quick pin having a shaft and a handle, said shaft is within said receptor hole when said latch assembly and said mounting bracket assembly are assembled together, and said handle engages said support of the latch assembly to prevent inward movement of said quick pin; and a securement component which attaches said support of the mounting bracket assembly to another portion of said clamp component of the latch assembly.

12. A front end loader for mounting to a piece of motive equipment, comprising:

a front end loader frame having a working end location and an attachment end location;

a bucket attached to said working end location of the frame;

a latch assembly secured to said attachment end location of the frame for mounting the loader in mid-mount fashion to a piece of motive equipment, said latch assembly including a support, a first pedestal pin, a second pedestal pin, and a clamp component;

a mounting bracket assembly adapted to be secured to a mid-mount location of a piece of motive equipment, said mounting bracket assembly including:

a bracket assembly support, a first pedestal supported by said bracket assembly support, said first pedestal being sized and shaped to receive said first pedestal pin, and a second pedestal supported by said bracket assembly support, said second pedestal being sized and shaped to receive said second pedestal pin;

a first securement component which attaches said support of the latch assembly to one portion of said clamp component of the latch assembly;

a second securement component which attaches said support of the mounting bracket assembly to another portion of said clamp component of the latch assembly;

said second securement component is generally T-shaped and has a generally transverse portion which is secured to said support of the mounting bracket assembly, and said generally T-shaped component has a generally longitudinal portion which is secured to said clamp component when said latch assembly and said mounting bracket assembly are assembled together; and said generally longitudinal portion includes an eye bolt having an eye through which the generally transverse portion is positioned.

13. The front end loader according to claim 12, wherein said generally longitudinal portion further includes an extension nut which secures said clamp onto said generally longitudinal portion.

14. The front end loader according to claim 11, further including a handle wrench supported from said support of the latch assembly, and said handle wrench is positioned for engagement of said quick pin to prevent outward movement of said quick pin.

15. The front end loader according to claim 14, wherein said handle wrench is supported from said support of the latch assembly by a projecting shelf member having at least one hole through which said handle wrench passes.

16. The front end loader according to claim 10, wherein said first securement component has a storage position on said support of the mounting bracket assembly when said latch assembly and said mounting bracket assembly are not assembled together.

17. A procedure for mounting a mid-mount front end loader to a piece of motive equipment, the front end loader having a frame with a working end location and an attachment end location, a bucket attached to the working end location of the frame, and a latch assembly secured to the attachment end location of the frame, comprising:

providing the latch assembly of the front end loader with a support having a first pedestal pin, a second pedestal pin and a clamp component;

securing to the piece of motive equipment a mounting bracket assembly at a mid-mount location, the mounting bracket assembly including a bracket assembly support having a first pedestal and a second pedestal;

effecting relative movement between the front end loader and the piece of motive equipment until said respective first and second pedestal pins locate within said respective first and second pedestals and until an opening through said support of the latch assembly is in general alignment with an opening through the mounting bracket assembly, and inserting a first securement component through these openings to thereby attach together the latch assembly and the mounting bracket assembly;

engaging the clamp component of the latch assembly with a second securement component projecting from the mounting bracket assembly; and securing the clamp component to the mounting bracket assembly by means of the second securement component.

* * * * *

UNITED STATES PATENT AND TRADEMARK OFFICE

CERTIFICATE OF CORRECTION

PATENT NO. : 6,386,821 B1
DATED : May 14, 2002
INVENTOR(S) : Schneider

It is certified that error appears in the above-identified patent and that said Letters Patent is hereby corrected as shown below:

Title page,
Item [74], *Attorney, Agent, or Firm*, after "McFarron," insert -- Manzo, --.

Column 1,
Line 10, before "the tractor" insert -- of --.

Column 2,
Line 43, after "provide" insert -- an --.

Column 3,
Line 18, delete "assembles" and insert -- assemblies --.

Column 4,
Line 2, after "and raise" insert -- or --.
Line 3, delete "cylinder FIG." and insert -- cylinder 27 (FIG. --.
Line 37, after "it will" insert -- be --.

Column 5,
Line 4, delete "included" and insert -- including --.

Column 7,
Line 5, delete "understand" and insert -- understood --.

Signed and Sealed this

Twenty-first Day of January, 2003

JAMES E. ROGAN
*Director of the United States Patent and Trademark Office*